US010555586B1

(12) United States Patent
Yeager, Jr.

(10) Patent No.: US 10,555,586 B1
(45) Date of Patent: Feb. 11, 2020

(54) FRAGRANCE BODY BAND

(71) Applicant: Ricky V. Yeager, Jr., Fredericksburg, VA (US)

(72) Inventor: Ricky V. Yeager, Jr., Fredericksburg, VA (US)

( * ) Notice: Subject to any disclaimer, the term of this patent is extended or adjusted under 35 U.S.C. 154(b) by 186 days.

(21) Appl. No.: 15/722,179

(22) Filed: Oct. 2, 2017

Related U.S. Application Data

(63) Continuation-in-part of application No. 14/549,013, filed on Nov. 20, 2014, now abandoned.

(51) Int. Cl.

| | |
|---|---|
| ***A44C 5/00*** | (2006.01) |
| ***A44C 15/00*** | (2006.01) |
| ***B65D 83/00*** | (2006.01) |
| ***A61Q 13/00*** | (2006.01) |

(52) U.S. Cl.
CPC ..... *A44C 5/0007* (2013.01); *A44C 15/002* (2013.01); *A44C 5/0084* (2013.01); *A61Q 13/00* (2013.01); *B65D 83/00* (2013.01)

(58) Field of Classification Search
CPC ... A44C 5/0007; A44C 15/002; A44C 5/0084; A61Q 13/00; B65D 83/00
See application file for complete search history.

(56) References Cited

U.S. PATENT DOCUMENTS

2003/0072834 A1* 4/2003 Wang ..... B29C 45/2673 425/190
2008/0280466 A1* 11/2008 Sitz ..... G06K 19/077 439/131
2009/0196587 A1* 8/2009 Cheung ..... A61L 9/037 392/394

* cited by examiner

*Primary Examiner* — Laura C Powers
(74) *Attorney, Agent, or Firm* — Cramer Patent & Design, PLLC; Aaron R. Cramer

(57) ABSTRACT

A band is capable of retaining a substrate saturated with a fragrance. A user dons the band around a portion of their body. The band incorporates a plurality of perforations enabling the fragrance emitting from the substrate to permeate an immediate area adjacent the band.

8 Claims, 6 Drawing Sheets

FRAGRANCE BODY BAND

RELATED APPLICATIONS

The present invention is a continuation-in-part of, was first described in, and claims the benefit of U.S. patent application Ser. No. 14/549,013, filed Nov. 20, 2014, the entire disclosures of which are incorporated herein by reference.

FIELD OF THE INVENTION

The present invention relates generally to a body band including an aromatic fragrance.

BACKGROUND OF THE INVENTION

In today's world, nearly everyone places a great deal of importance on smelling nice. A trip to just about any store to see the amount of perfumes, deodorants, colognes, soaps, shampoos, sport sprays, and the like, quickly reinforces this fact. However, the length of time such enjoyably scented items continue to emit a perceptible fragrance is often limited and it is seldom advisable to initially heavily apply such products. It is therefore necessary to freshen up or reapply one's preferred fragrance. However, during the course of a given day it is not always easy to re-apply such items when out and about.

In addition to the short-lived nature of the fragrances we apply an average person will also encounter or run into stale odors, cigarette smoke, food smells, chemical smells, and other olfactory offenses. These unpleasant odors often adhere to the person and his or her clothing. In the most extreme cases, even the strongest perfumes and colognes cannot overcome such bad odors. Unfortunately, this smell then presents a negative image to others that a person meets throughout the day. Accordingly, there exists a need for a means by which one can present a pleasant and persistent, but not overpowering fragrance that additionally masks other unpleasant smells encountered during a single day. The use of the present invention allows one to apply, and use their favorite cologne/perfume, without the necessity of carrying an entire bottle.

SUMMARY OF THE INVENTION

The inventor has recognized the aforementioned issues and inherent problems and observed that there is a lack in the prior art for a fragrance body band.

It is therefore an object of the invention to provide for a fragrance body band comprising an outer cover removably attachable to a base. An interior is defined between the base and the outer cover, within which a substrate can be situated at least within a portion of the interior. At least one (1) perforation is located on the outer cover, each of which at least a portion thereof to be in fluid and environmental communication with the interior.

It is therefore an object of the invention to provide that the outer cover and base are composed of a flexible and resilient material. Such a material can be a silicone rubber compound.

The first surface and second surface are generally configured as a narrow cylinder to facilitate wearing about a limb or appendage, necklace or chain, or hair of a person.

It is therefore another object of the invention to provide for a texturized surface on either or both the base and the outer cover.

In the event that the substrate is impregnated, covered, coated, or otherwise imbued with a fragrant material, the plurality of perforations enable the emitting fragrance to saturate the immediate area of the band. chain, or hair of a person. The first surface and second surface are composed of a silicone rubber compound and textured material.

It is therefore another object of the invention to provide a fill hole located on the base that is in fluid communication with the interior to enable the introduction of the fragrance to the substrate, if so desired.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
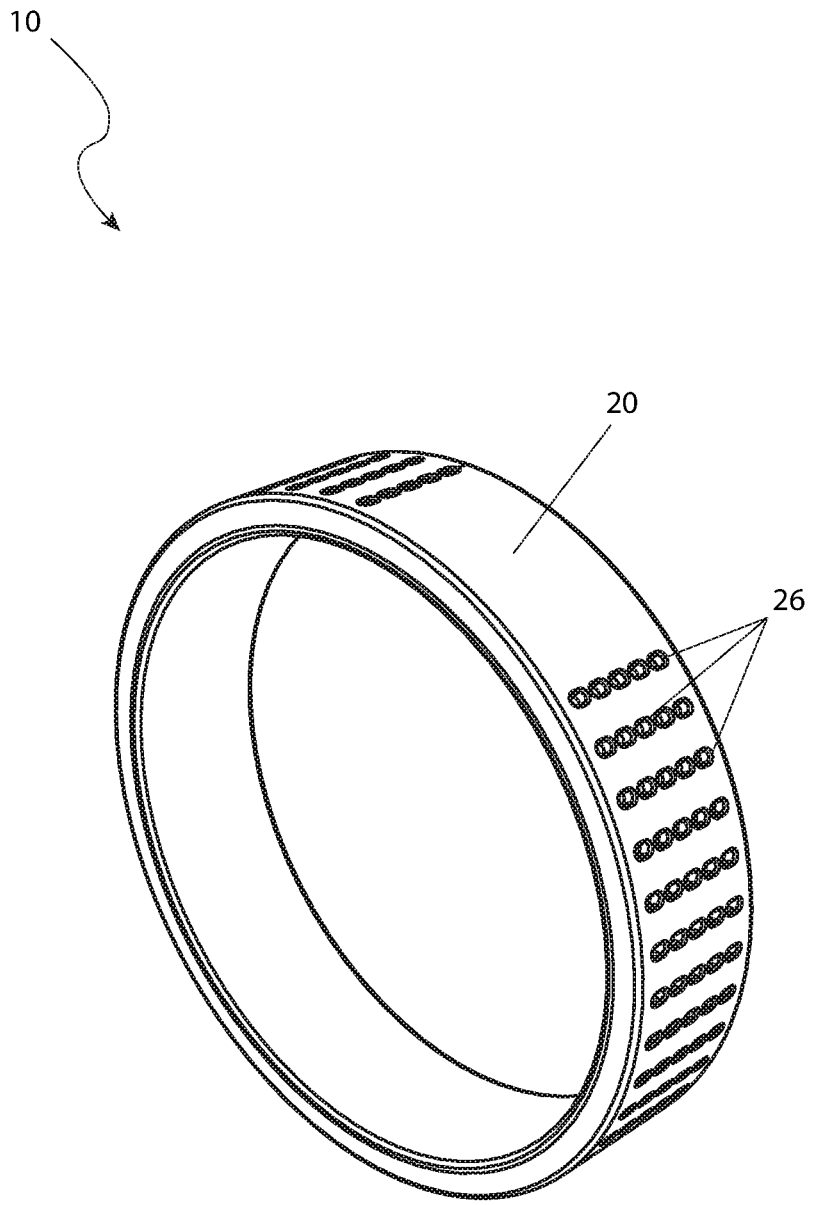
FIG. 1 is a perspective view of a fragrance body band 10 in accordance with the preferred embodiment of the present invention.

10 band
20 outer cover
22 interior
24 base
26 perforation
27 lip
30 fill hole
40 first step
45 second step
50 first alternate outer cover
51 first alternate perforation
52 second alternate outer cover
53 second alternate perforation
54 third alternate outer cover
55 third alternate perforation
56 fourth alternate outer cover
57 fourth alternate perforation

DETAILED DESCRIPTION OF THE PREFERRED EMBODIMENT

The preferred embodiment of the present invention can be utilized in a simple and straightforward manner with little or no training After initial purchase or acquisition of the band 10, it would be provided as indicated in FIGS. 1-5, where the outer cover 20 is attached to the base 24. FIGS. 6*a*-6*d* reflect multiple embodiments of the outer cover 50, 52, 54, 56. The method of installing and utilizing the band 10 may be achieved by performing the following steps: acquiring a model of the band 10 where the outer cover 20, 50, 52, 54, 56 has a desired style to suit the user; filling the band 10 with a preferred fragrance, and wearing the band 10 on a selected portion of the user's body or hair; and pursuing normal activities.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The present invention describes a body band (herein referred to as the "band") 10, which provides a means to wear a continuing supply of a fragrance, suitable to a user, to overcome other odors and aromas encountered during the period of use.

Referring now to FIG. 1, a perspective view of the band 10 according to the preferred embodiment of the present invention, is disclosed. The band 10 includes an outer cover 20, generally configured as a cylindrical body, and a base 24, also configured as a cylindrical body, sized so as to enable the outer cover 20 to snugly fit therein. Both the base 24 and the outer cover 20, when combined, provide an overall general shape of a bracelet, or a ring, and can be worn as such. In a preferred embodiment, the overall heights of the band 10 is one hundred forty-one-thousandths of an inch (0.141 in.).

Figure 2:
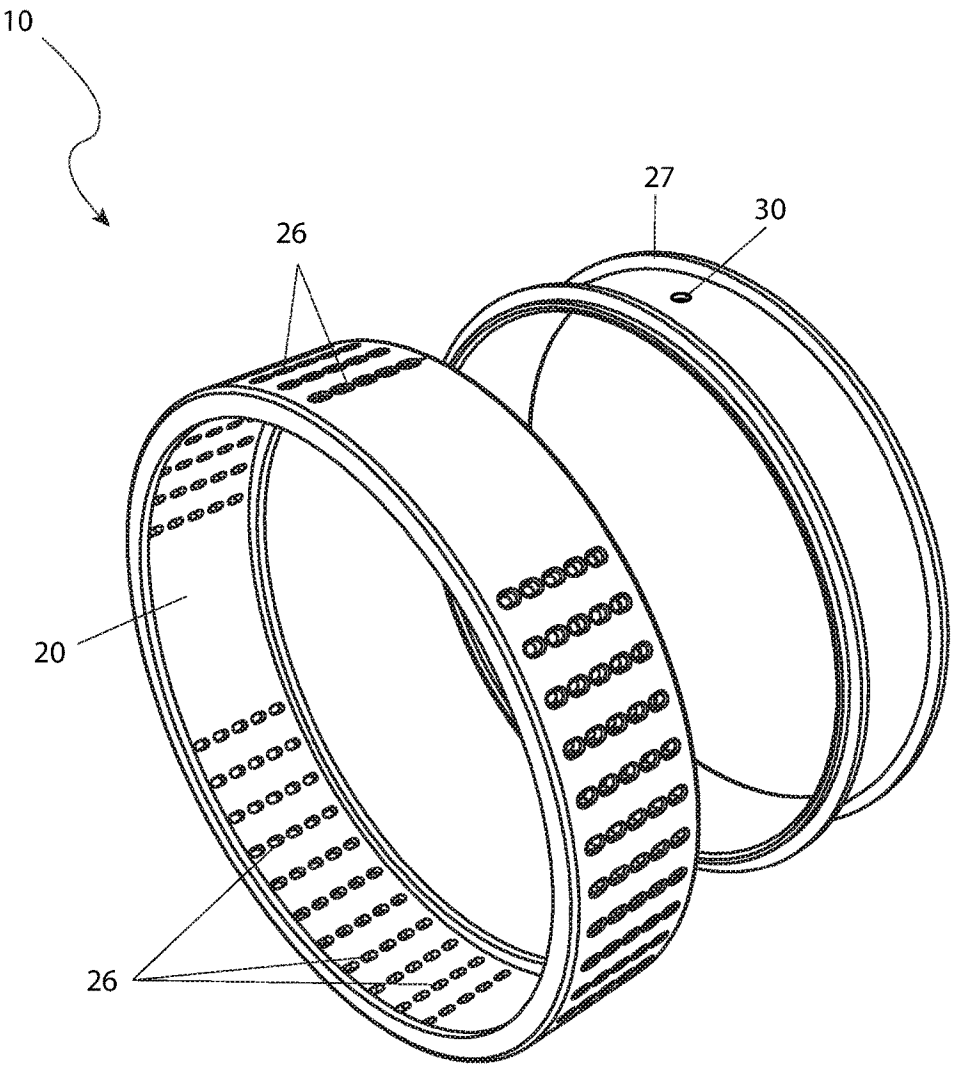
FIG. 2 is an exploded perspective view of the fragrance body band 10 in accordance with the preferred embodiment of the present invention.
Figure 4:
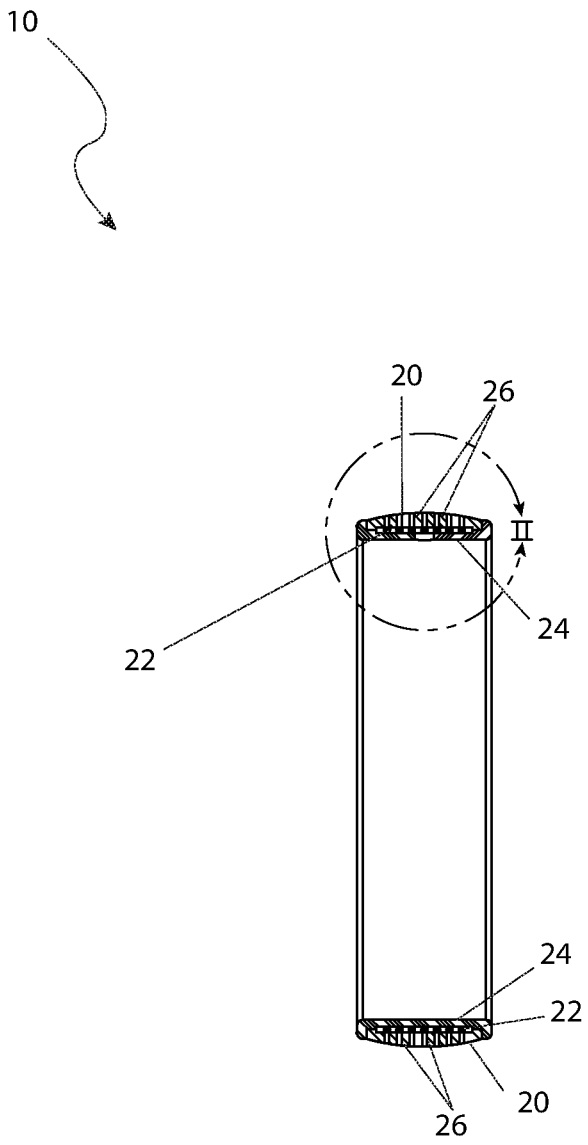
FIG. 4 is a cut-away view of the fragrance body band 10 along the line I-I (see FIG. 2) in accordance with the preferred embodiment of the present invention.

FIG. 2, shows the exploded view of the outer cover 20 removed from the base (FIG. 4, 24). The base 24 as previously described is a cylindrical body, having a slightly convex first side and a second side. For purposes or orientation, the second side of the base 24 is the side that contacts the wearer or the supporting device the band 10 rests on. In a preferred embodiment, the width of the base 24 is seven-tenths of an inch (0.7 in.). Passing through the base 24 is at least one (1) fill hole 30, which may be located at any desired position. The first side of the base 24 has a pair of continuous lips 27, located at opposing perimeter edges. In a preferred embodiment, each lip 27 has a width of fifty-thousandths of an inch (0.50 in.). The area between the lips 27 of the base 24 is such that it enables the placement of the outer cover 20 fully therein, with a friction fit engagement. The material of the outer cover 20 and/or the base 24 may be such that there is a slight flexibility it to enable such a fit. A pair of first steps 40 are each located at an equidistant location from the inner surface of each lip 27.

The outer cover 20 is also a cylindrical body, having a width enabling that its placement on the base 24 is fully between the lips 27. The outer cover 20 has a slightly convex first side and a pair of second steps 45 located on the inner side perimeter edges. For purposes of orientation, the first side of the outer cover 20 is exposed to the environment. A plurality of perforations 26 adorn the outer cover 20 and can be in any orientation, and configuration, and located in any position thereon (please see FIGS. 6*a*-6*d*). These perforations 26 may, in some cases, be spaced at regular intervals over at least a portion of the outer cover 20. The perforations 26 may also be spaced in a random pattern over part, or all, of the outer cover 20 without limiting the scope of the band 10. In a preferred embodiment, the plurality of perforations 26 are located between the pair of second steps 45 and arranged in a set of four (4) distinct sections as a grid pattern. Each perforation is a circle having a diameter of thirty-three thousandths of an inch (0.033 in.).

The base 24 and/or the outer layer 20 is preferably composed of a silicone rubber compound, or other such material, having elastic properties to provide flexibility and resilience and as such may be presented in a wide variety of colors and surface finish textures. The outer surface 20 may be provided with texturing to simulate decorative embellishments such as woven materials or faceting. Additionally, it is envisioned that some surface portions of the base 24 and/or the outer layer 20 may include various indicia which may provide script or logos based upon a user's preference and may include images such as, but not limited to, business names/logos, personal names, product names, symbols, lines, pictures, and the like, in various colors and patterns, to further customize and personalize the band 10.

Figure 3:
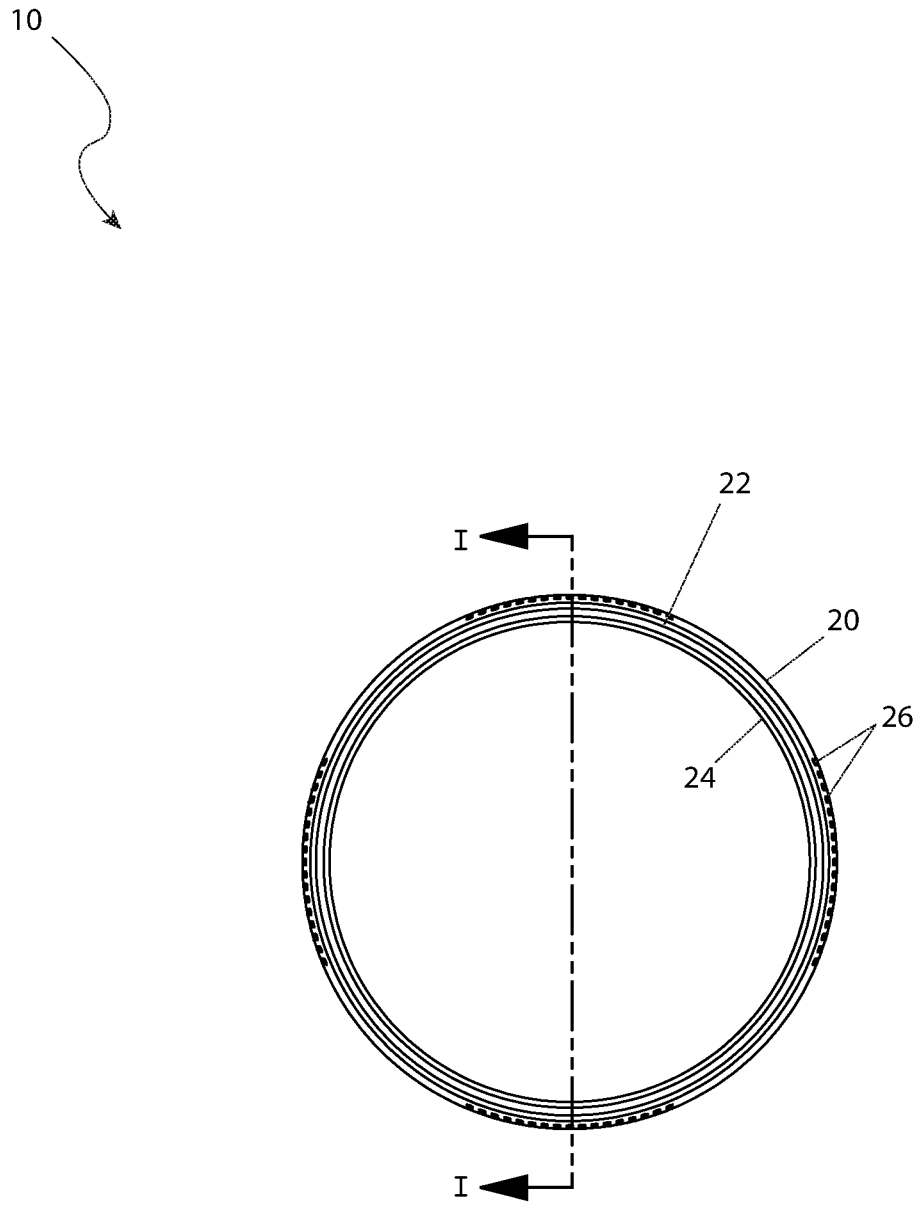
FIG. 3 is a side view of the fragrance body band 10 in accordance with the preferred embodiment of the present invention.
Figure 5:
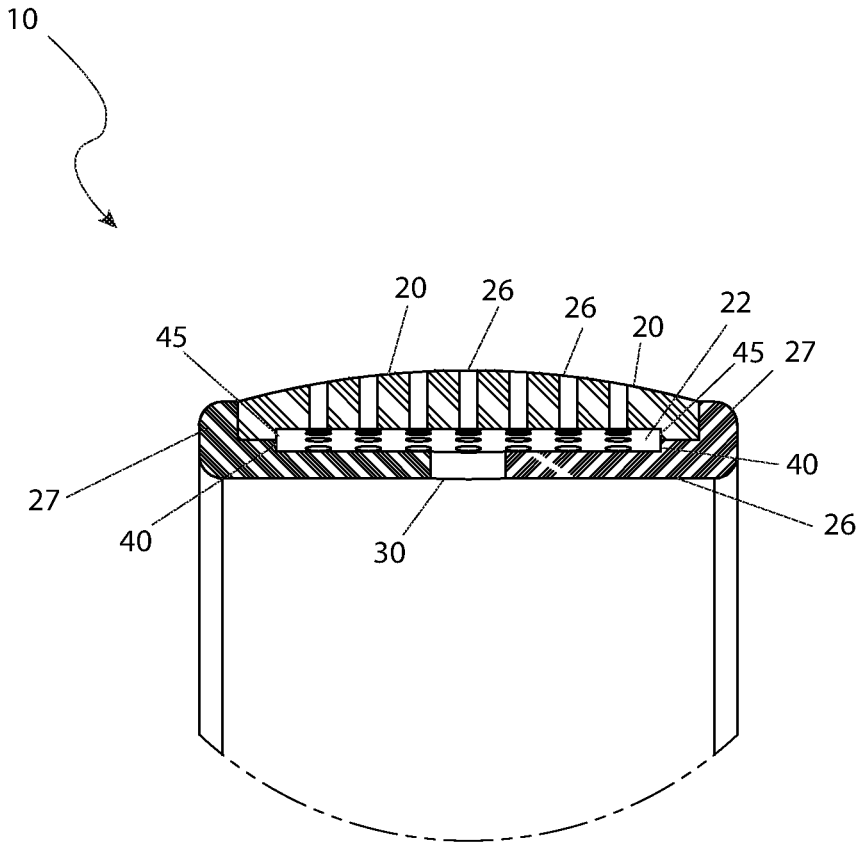
FIG. 5 is a close up view of the fragrance body band 10 of detail II (see FIG. 3) in accordance with the preferred embodiment of the present invention.

Referring now to FIGS. 3-5, an interior 22 is defined as the circumferential area between the first steps 40 and second steps 45 when the outer cover 20 is fully inserted between the lips 27 of the base 24 and attached thereto. In a preferred embodiment, such an interior has a width of five-tenths of an inch (0.5 in.) and a height of three-hundredths of an inch (0.03 in.). Therefore, the distance between the pair of first steps 40 is five-tenths of an inch (0.5 in.) and the distance between the pair of second steps 45 is also five-tenths of an inch (0.5 in.). The height of each of the pair of first steps 40 from the inner floor of the base 24 therefore is fifteen-thousandths of an inch (0.015 in.) and the height of each of the pair of second steps 45 from the inner floor of the outer cover 20 is also fifteen-thousandths of an inch (0.015 in.). It is preferred the interior 22 is in fluid and environmental communication with the plurality of perforations 26 and the fill hole 30.

The band 10 is capable of receiving and retaining a substrate capable of being impregnated or coated with a fragrance. It is anticipated that the variability in fragrances would dictate that some, such as floral scents, be released from oils, while others would be sublimated from a solid form, and still others would result from the evaporation of some liquid. It is understood that the composition of the substrate would require some variability depending on the particular fragrance that was formulated to be released. The substrate may, for an example, be a piece of cotton, or cotton fabric, or a plurality of cotton pieces, soaked in a solution which will evaporate to release a fragrance. Another example of a substrate may be polyester fibers comingled with a fragrance source suspended in wax beads.

The second side of the base 24 may be provided with such texturing as may beneficially allow perspiration to be channeled away from the user's skin in the locality of said band 10 so as to obviate any discomfort. The second side of the base 24 may alternately be coated with a desiccant powder to achieve the same result.

Figures 6A, 6B, 6C, 6D:
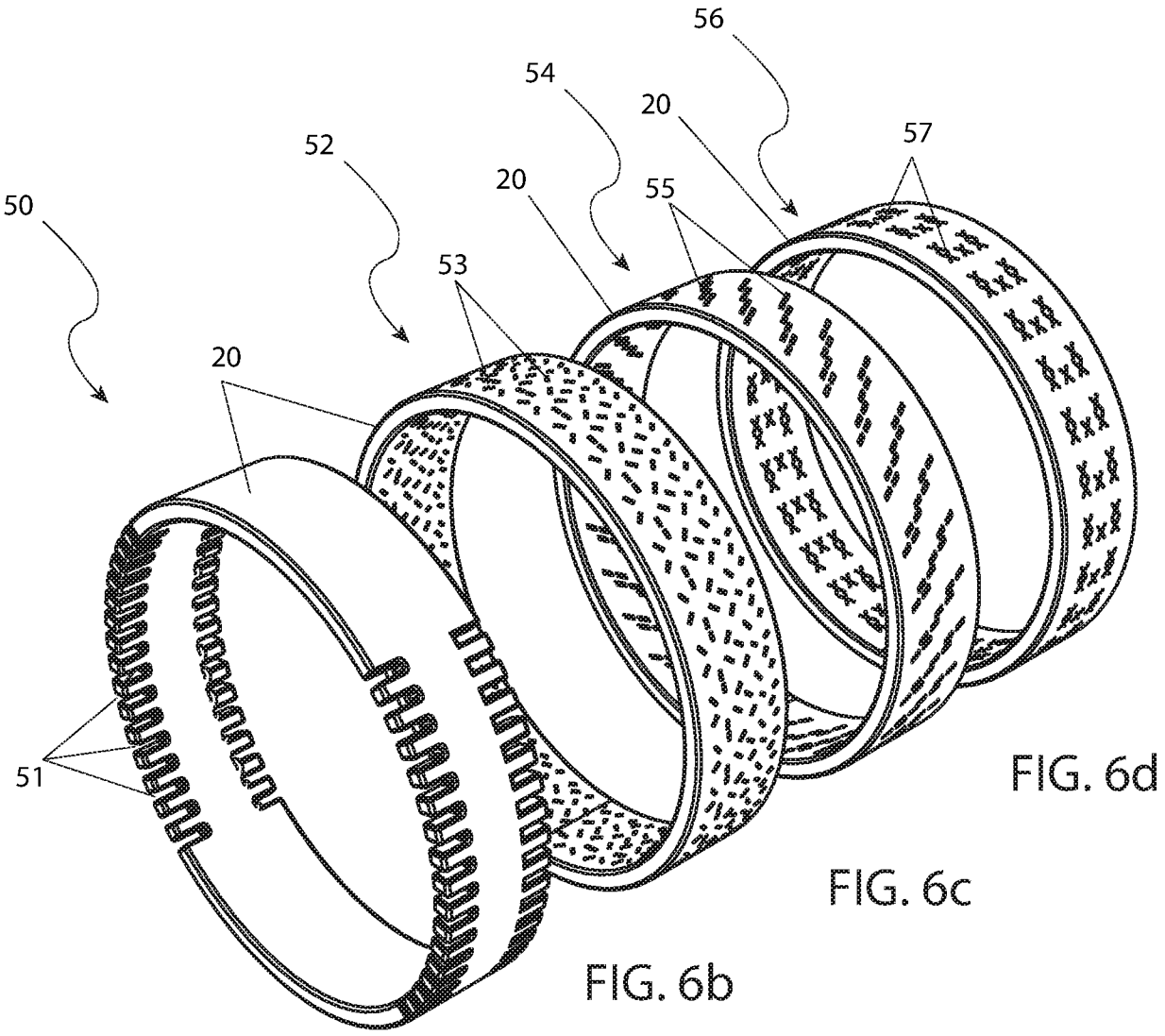
FIG. 6*a* is a perspective view of the fragrance body band 10 having a first alternate outer cover 50 in accordance with the preferred embodiment of the present invention.
FIG. 6*b* is a perspective view of the fragrance body band 10 having a second alternate outer cover 52 in accordance with the preferred embodiment of the present invention.
FIG. 6*c* is a perspective view of the fragrance body band 10 having a third alternate outer cover 54 in accordance with the preferred embodiment of the present invention; and, FIG. 6*d* is a perspective view of the fragrance body band 10 having a fourth alternate outer cover 56 in accordance with the preferred embodiment of the present invention.

FIGS. 6*a*-6*d* illustrate different embodiments, 50, 52, 54, 56 of an outer cover 20 that can be utilized with the band 10, but by no means limits the scope of any outer cover 20 or plurality of perforations 26 to be achieved within the scope of the present invention. As such, FIGS. 6*a*6-*d* illustrate certain embodiments 50, 52, 54, 56 that can be utilized. The perforations 51, 53, 55, 57 described herein also have at least a portion in fluid and environmental communication with the interior 22 when the outer cover 20 is attached to the base 24. FIG. 6*a* illustrates a first alternate embodiment 50, where the plurality of first alternate perforations 51 are rectangular in shape and oriented in a repeated fashion, where a portion of the first alternate perforations 51 are in fluid and environmental communication with the interior 22 as described and a portion extending along the outer perimeter edge of the outer cover 20. FIG. 6*b* illustrates a second alternate embodiment 52, where the plurality of second alternate perforations 53 are rectangular in shape and oriented in a random fashion. FIG. 6*c* illustrates a third alternate embodiment 54, where the plurality of third alternate perforations 55 are rectangular in shape and oriented in a repeated fashion. FIG. 6*d* illustrates a fourth alternate embodiment 56, where the plurality of fourth alternate perforations 57 are an "x" shape and oriented in a three (3) columns, in a repeated fashion.

When the band 10 is desired to be worn and operate as a fragrant emanating device, if previously attached, the outer cover 20 should be removed from the base 20. A substrate is then placed on the inner floor of the base 24 (i.e. the base first side). The desired outer cover 20, 50, 52, 54, 56 (or some other) is then placed on the first side of the base 24 and fit between the lips 27. This then positions or orients at least a portion of the substrate within the interior 22. A desired fragrance is applied then to the substrate through the fill hole 30. Alternately, the substrate can have the fragrance applied thereto prior to placement on the base 24. The fragrance then emanates, due to ambient conditions through the plurality of perforations 26, 51, 53, 55, 57 and through the fill hole 30. It is preferred that the majority of the fragrant emissions occurs through the perforations 26, 51, 53, 55, 57.

The foregoing descriptions of specific embodiments of the present invention have been presented for purposes of illustration and description. They are not intended to be exhaustive or to limit the invention and method of use to the precise forms disclosed. Many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A band, comprising:

a base, having a base first side and a base second side, further comprising a pair of lips located at opposing perimeter edges, each of the pair of lips is extending outward away from said base first side;

an outer cover, having a cover first side and a cover second side, said outer cover having a plurality of perforations boated thereon, said cover second side removably attachable to said base first side between said pair of ups;

wherein when said outer cover is removably attached to said base, an interior is defined;

wherein said interior is capable of retaining a substrate therein;

wherein said base and said outer cover comprises a flexible and resilient material;

wherein each of said plurality of perforations are in fluid and environmental communication with said interior;

a pair of first steps, each upstanding from a surface of said base first side and each located at an equidistant position from an individual lip;

a pair of second steps, each upstanding from a surface of said outer cover second side;

wherein when said outer cover is removably attached to said base, said interior is defined as an area defined between said base first side, said outer cover second side, said pair of first steps, and said pair of second steps;

wherein said outer cover and base are cylindrical-shaped;

wherein said band is configured to facilitate wearing about a limb or appendage of a person;

wherein said base is a silicone rubber compound;

and wherein said outer cover is a silicone rubber compound.

2. The band of claim 1, wherein said outer cover first side comprises a textured material.

3. The band of claim 2, wherein said base second side comprises a textured material.

4. The band of claim 1, wherein said base second side comprises a textured material.

5. A band, comprising:

a base, having a base first side and a base second side, further comprising a pair of lips located at opposing perimeter edges, each of the pair of lips is extending outward away from said base first side, and a fill hole;

an outer cover, having a cover first side and a cover second side, said outer cover having a plurality of perforations located thereon, said cover second side removably attachable to said base first side between said pair of lips;

wherein when said outer cover is removably attached to said base, an interior is defined;

wherein said interior is capable of retaining a substrate therein;

wherein said base and said outer cover comprises a flexible and resilient material;

wherein said fill hole is in fluid and environmental communication with said interior;

wherein each of said plurality of perforations are in fluid and environmental communication with said interior;

a pair of first steps, each upstanding from a surface of said base first side and each located at an equidistant position from an individual lip;

a pair of second steps, each upstanding from a surface of said outer cover second side;

wherein when said outer cover is removably attached to said base, said interior is defined as an area defined between said base first side, said outer cover second side, said pair of first steps, and said pair of second steps;

wherein said outer cover and base are cylindrical shaped;

wherein said band is configured to facilitate wearing about a limb or appendage of a person;

wherein said base is a silicone rubber compound;

and wherein said outer cover is a silicone rubber compound.

6. The band of claim 5, wherein said outer cover first side comprises a textured material.

7. The band of claim 6, wherein said base second side comprises a textured material.

8. The band of claim 5, wherein said base second side comprises a textured material.

* * * * *